US005868094A

United States Patent [19]

Al-Sabah

[11] Patent Number: 5,868,094

[45] Date of Patent: Feb. 9, 1999

[54] ANCHORING APPARATUS AND METHOD OF ANCHORING

[76] Inventor: Sabah Naser Al-Sabah, P.B. 36777 Al-Ras, 24758 Kuwait, Kuwait

[21] Appl. No.: 52,543

[22] Filed: Mar. 31, 1998

Related U.S. Application Data

[63] Continuation-in-part of Ser. No. 815,893, Mar. 12, 1997, Pat. No. 5,743,207.

[51] Int. Cl.[6] ..... B32B 21/24

[52] U.S. Cl. ..... 114/301; 114/294

[58] Field of Search ..... 114/294–299, 301–310

[56] References Cited

U.S. PATENT DOCUMENTS

| | | | |
|---|---|---|---|
| D. 343,607 | 1/1994 | Martin | D12/215 |
| 3,776,172 | 12/1973 | Lambert | 114/301 |
| 4,134,355 | 1/1979 | Carruthers | 114/297 |
| 4,385,584 | 5/1983 | Simpson, III | 114/301 |
| 4,397,257 | 8/1983 | Colin | 114/304 |
| 4,644,894 | 2/1987 | Woodgate | 114/304 |
| 4,951,593 | 8/1990 | Brown et al. | 114/297 |
| 4,972,793 | 11/1990 | Sakai | 114/304 |
| 5,542,368 | 8/1996 | Yoshioka | 114/301 |

*Primary Examiner*—Jesus D. Sotelo

*Attorney, Agent, or Firm*—Allen, Dyer, Doppelt, Milbrath & Gilchrist, P.A.

[57] ABSTRACT

An apparatus and method for anchoring a buoyant device are provided. The apparatus preferably includes first, second, and third plates adjoined along a common line. An end of the second plate is transversely connected to an end of the first plate along the common line and extends inwardly therefrom at a predetermined angle so that the first and second plates in combination define an angled plate member. A third plate is adjoined along the common line and extends outwardly therefrom in a different direction from the angled plate member. A shank is pivotally connected to a medial portion of the angled plate member and extends outwardly therefrom. At least one prong member is connected to and extends outwardly from the outer surface of each of the first and second plates of the angled plate member.

30 Claims, 8 Drawing Sheets

20

20

ANCHORING APPARATUS AND METHOD OF ANCHORING

RELATED APPLICATIONS

This application is a continuation-in-part of U.S. patent application Ser. No. 08/815,893 filed on Mar. 12, 1997 now U.S. Pat. No. 5,743,207 and which is hereby incorporated herein by reference in its entirety.

FIELD OF THE INVENTION

The present invention relates to the field of aquatic or marine devices and, more particularly, to an anchoring apparatus for buoyant devices in the aquatic or marine industry.

BACKGROUND OF THE INVENTION

Boat anchors have been developed over the years for stabilizing or bracing boats or other buoyant devices when positioned in the water. An anchor can generally be described as a large or heavy device which embeds into the floor of a sea, lake, river, or other body of water to brace a boat or other buoyant device. Conventional anchors have hooks, flukes, or barbs which embed into or snag underwater terrain to accomplish the bracing function. Advance have been made over the years in the structural design of anchors to make them easier to handle or transport, which enables the anchor to readily reach the waterway floor or other underwater terrain, and which increases the anchoring force when launching, positioning, or setting an anchor. Some examples of these advances can be seen in U.S. Pat. No. 4,972,793 by Sakai titled "*Anchor*," U.S. Pat. No. 4,397,257 by Colin titled "*Sea Anchor In Particular For Large Ships,*" and British Published Patent Document No. 1,067,382 by Wright titled "*Improvements In Or Relating To Anchors.*"

Floors or the underwater terrain of these waterways, however, also often contain many natural as well as man-made obstacles, such as rocks, shrubbery, trees, sea plants, natural caverns, wreckage, or pollutants, with which anchors can become entangled. Generally, when a user of an anchor incurs difficulty in removing or dislodging an anchor from the underwater terrain by merely winching the anchor, the boat is guided in a reverse direction and the anchor is attempted to be removed when the boat is above or now behind the anchor in the opposite direction it was originally attempting to travel. If the anchor has portions thereof, e.g., a hook, fluke, or barb, lodged under a large rock, log, or some type of man-made obstacle, this conventional anchor removal process is often unsatisfactory. In other words, the anchor remains lodged under the obstacle or a user has problems in removing the anchor.

One cause of these anchor removal problems, for example, is that the hook, fluke, or barb can actually be further lodged under the obstacle when the upper shank of an anchor is pulled in the opposite direction. Accordingly, attempts have been made to develop anchors which can more easily be removed when lodged under obstacles. Examples of some of these attempts can be seen in U.S. Pat. No. 4,951,593 by Brown et al. titled "*Anchor With Snag Release Mechanics,*" U.S. Pat. No. 4,385,584 by Simpson, III titled "*Boat Anchor,*" U.S. Pat. No. 4,644,894 by Woodgate titled "*Anchor,*" and French Published Patent Document No. 1,466,433 by Garnier. These conventional "snag-release" anchors, however, are often complex which, for example, can increase the risk of entanglements, expensive to manufacture, and fail to be easily used on some of the various underwater terrain which an anchor can encounter.

SUMMARY OF THE INVENTION

With the foregoing in mind, the present invention advantageously provides an anchoring apparatus and method for anchoring which are readily adaptable for embedding into or lodging under various types of underwater terrain. Also, an anchoring apparatus of the present invention advantageously provides a simple structure which can readily be manufactured and which decreases the risk of entanglements during use. An anchoring apparatus according to the present invention additionally is light weight which advantageously enables various users to readily handle the anchoring apparatus during launching and winching and which can be readily adapted for various types of boats or other buoyant devices.

More particularly, an apparatus for anchoring a buoyant device is provided according to the present invention and preferably includes first and second plates adjoined along a common line. An end of the second plate is transversely connected to an end of the first plate along the common line and extends inwardly therefrom at a predetermined angle so that the first and second plates in combination define an angled plate member. A third pronged plate member is connected along the common line and extends outwardly therefrom in a different direction from the angled plate member. A shank is pivotally connected to a medial portion of the angled plate member and extends outwardly therefrom. At least one prong member is also connected to and extends outwardly from the outer surface of each of the first and second plates of the angled plate member.

According to another aspect of the present invention, an anchoring apparatus preferably also includes plate positioning means connected to the shank and the angled plate member for adaptively positioning the angled plate member in various arrangements for various types of underwater terrain surfaces and for adaptively removing the angled plate member when secured to various underwater terrain surfaces. The plate positioning means includes pivotal connecting means connected to a distal end portion of the shank for pivotally connecting the shank to the medial portion of the angled plate member.

A method according to the present invention preferably includes providing first, second, and third plates adjoined along a common line. An end of the second plate is transversely connected to an end of the first plate along the common line and extends inwardly therefrom at a predetermined angle so that the first and second plates in combination define an angled plate member. A third pronged plate member extends outwardly from the common line in a different direction from the angled plate member. The angled plate member has an opening formed in a medial portion thereof. A shank has a distal end portion extending through the opening of the angled plated member, is pivotally connected to the angle plate member, and extends outwardly therefrom. At least one prong member is connected to and extends outwardly from the outer surface of each of the first and second plates of the angled plate member. The method also includes pivoting the distal end portion of the shank between a plurality of positions.

Another method of anchoring an anchoring device which includes first, second plates, and third plates adjoined along a common line, an end of the second plate being transversely connected to an end of the first plate along the common line and extending inwardly therefrom at a predetermined angle so that the first and second plates in combination define an angled plate member is also included according to the present invention. The third plate is preferably pronged and extends outwardly from the common line in a different direction from the angled plate member. The method preferably includes pivoting the distal end portion of a shank connected to a medial portion of the angled plate member to a first position having a first portion of the outer surface of the distal end portion of the shank abuttingly contacting the inner surface of the first plate, pivoting the distal end portion of the shank to a second position having a second portion of the outer surface of the distal end portion of the shank abuttingly contacting the inner surface of the second plate, and pivoting the distal end portion of a shank to a third position having the first and second portions of the outer surface of the distal end portion of the shank positioned transverse to the inner surfaces of the first and second plates.

In still another method of anchoring an anchoring device according to the present invention, the method preferably includes pivoting the distal end portion of a shank connected to a medial portion of the angled plate member to a first position having a portion of the outer surface of the distal end portion of the shank abuttingly contacting an end of the elongate opening extending along the second plate. The distal end portion of the shank is pivoted to a second position having another portion of the outer surface of the distal end portion of the shank abuttingly contacting the other end of the elongate opening extending along the first plate. The distal end portion of a shank is also pivoted to a third position having the respective portions of the outer surface of the distal end portion of the shank positioned transverse to the inner surfaces of the first and second plates.

By advantageously pivoting between the plurality of positions with an angled plate member and the prongs of the hook members, the anchoring apparatus and methods advantageously provide a flexible anchoring device for various types and sizes of boats or other buoyant devices. Because the structure is light weight and easy to manufacture, the anchoring apparatus can advantageously be produced in high volume, be relatively inexpensive, and be easily sized for various uses. The various pivoting positions of the present invention advantageously provide an anchoring apparatus and method that readily embeds, sets, lodges, braces, or secures a boat or other buoyant device to the various underwater terrain surfaces and yet also readily can be dislodged from the various underwater terrain surfaces.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF PREFERRED EMBODIMENT

Figure 1:
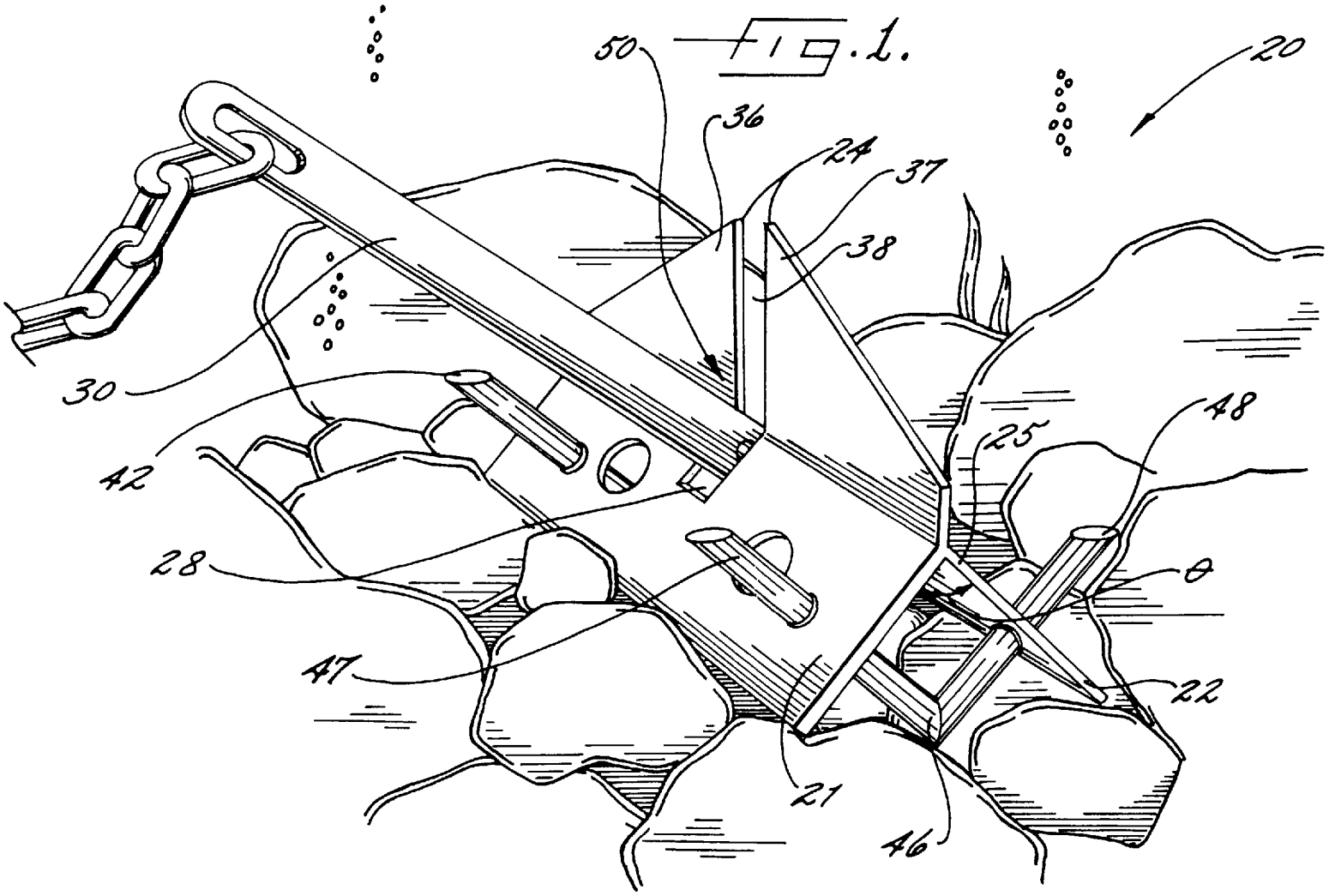
FIG. 1 is a perspective environmental view of an anchoring apparatus positioned in a first position according to an embodiment of the present invention.
Figure 2:
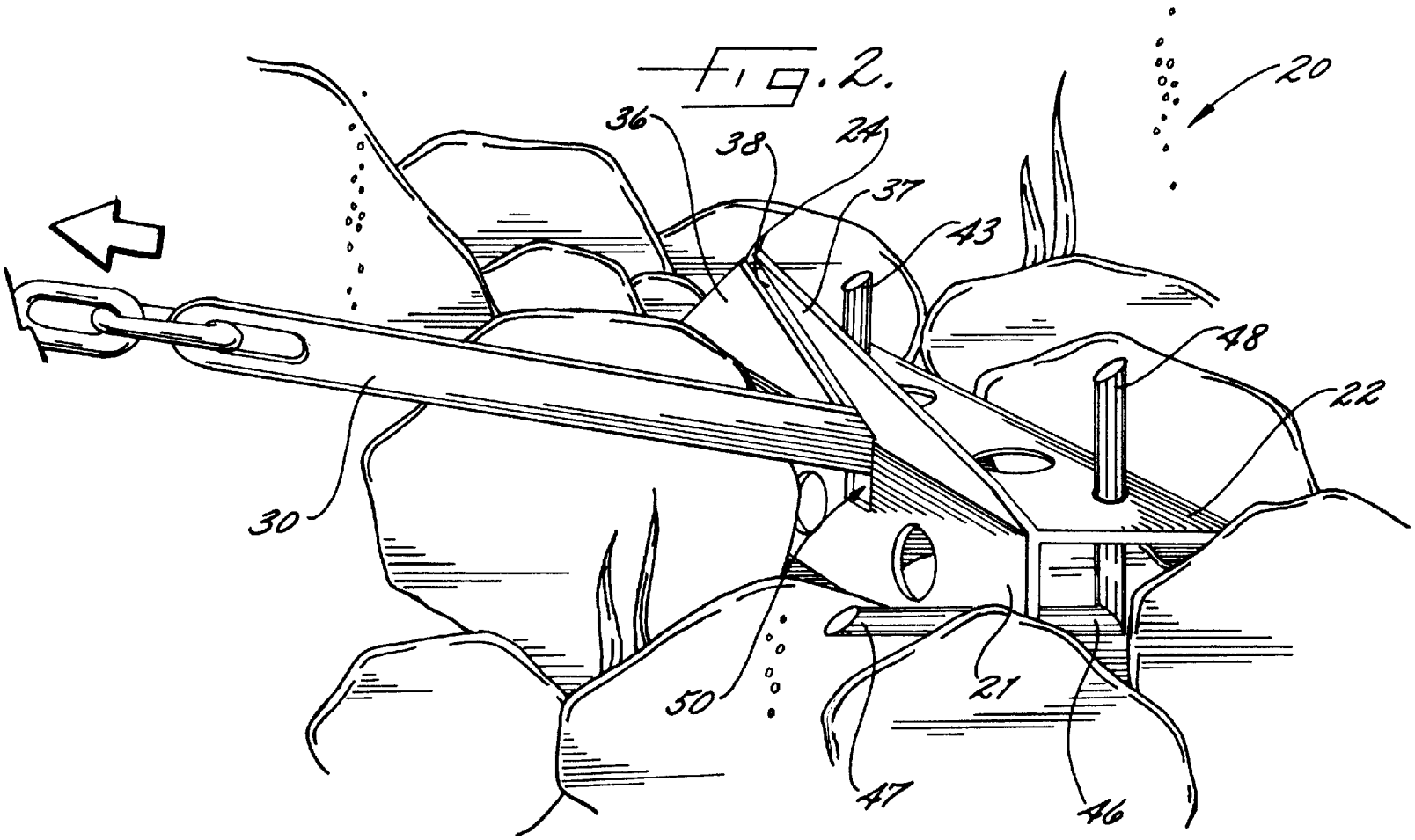
FIG. 2 is a perspective environmental view of an anchoring apparatus positioned in a first position according to an embodiment of the present invention.
Figure 3:
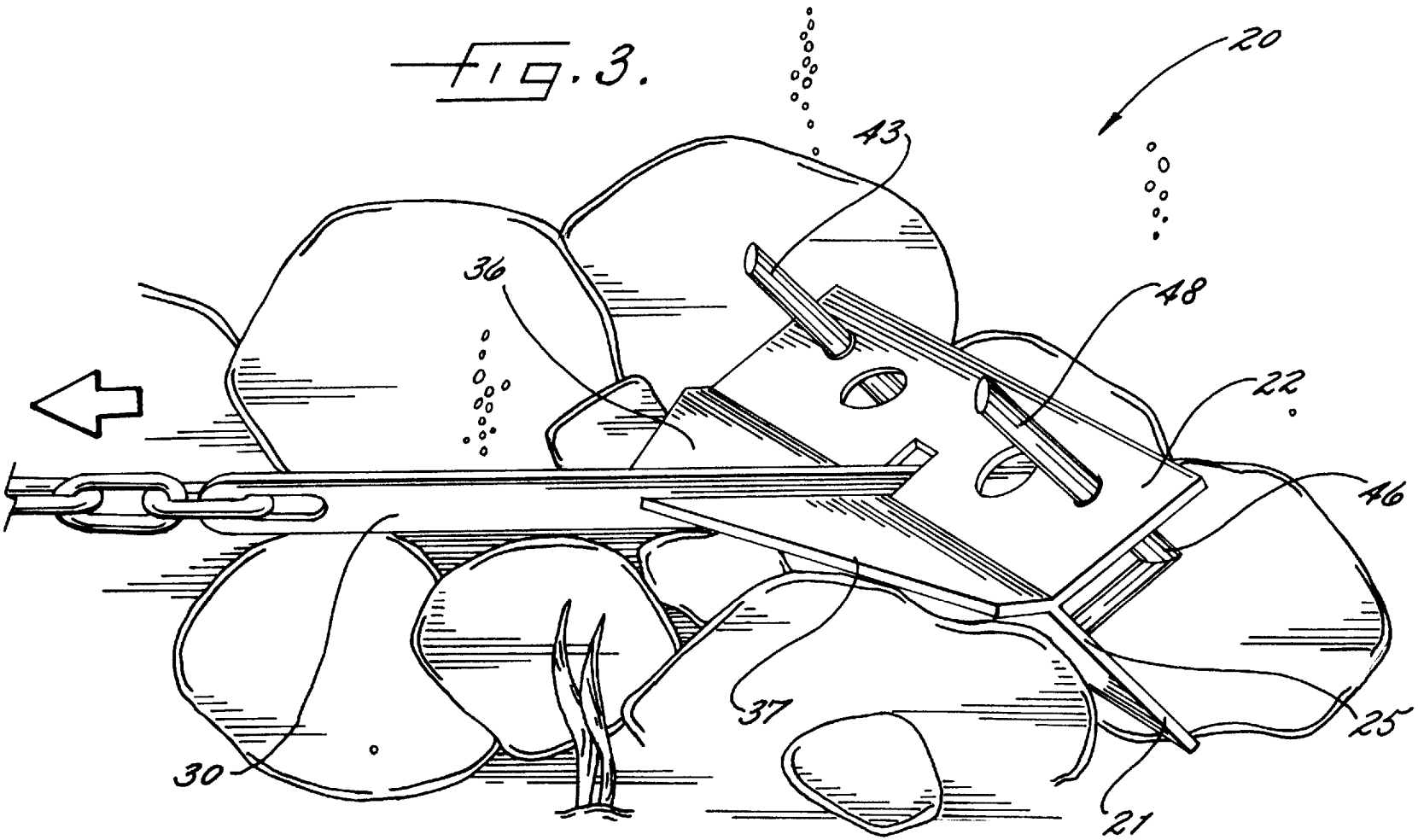
FIG. 3 is a perspective environmental view of an anchoring apparatus positioned in a second position according to an embodiment of the present invention.
Figure 4:
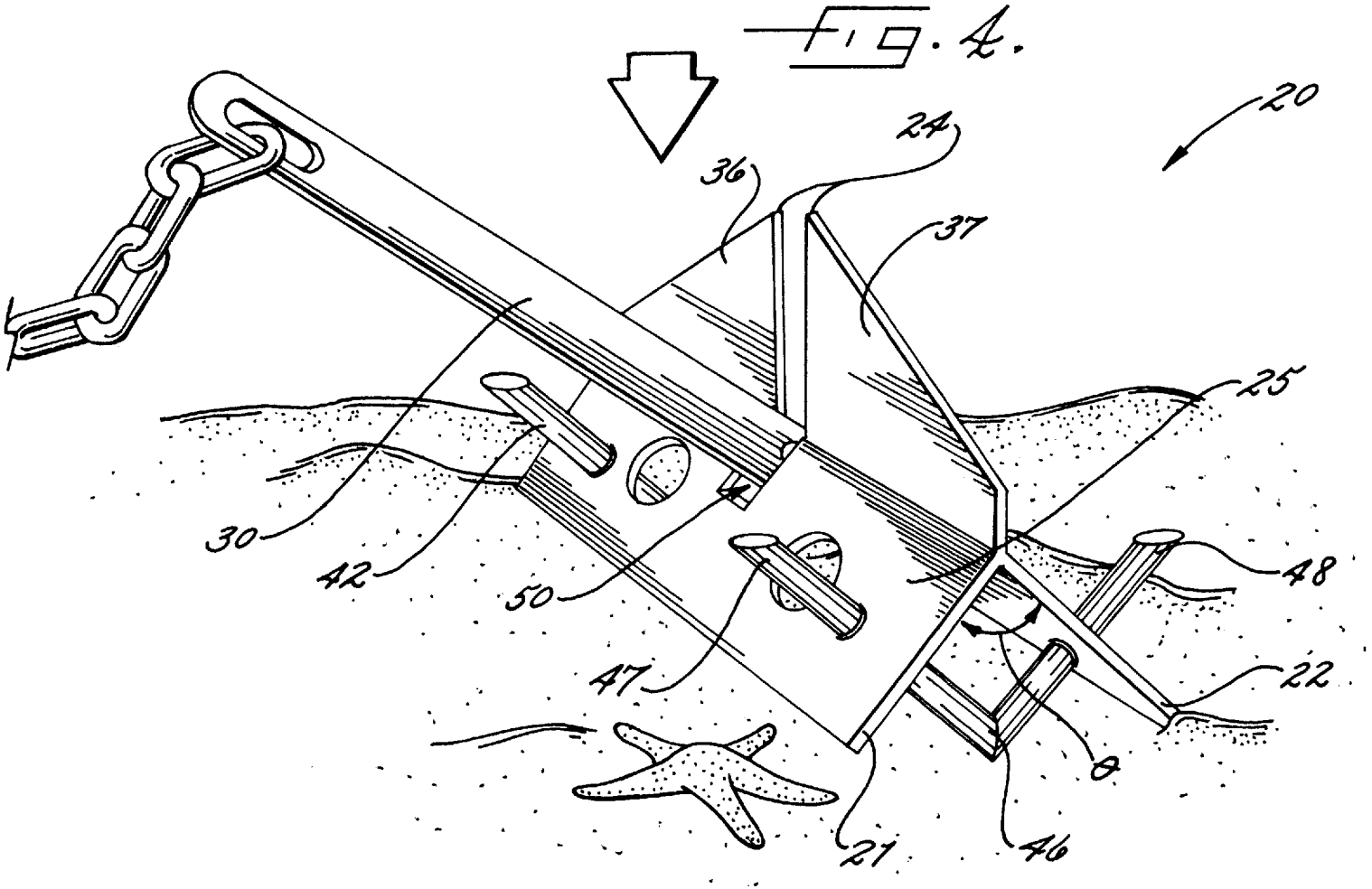
FIG. 4 is a perspective environmental view of an anchoring apparatus positioned in a first position upon a sandy surface according to an embodiment of the present invention.
Figure 5:
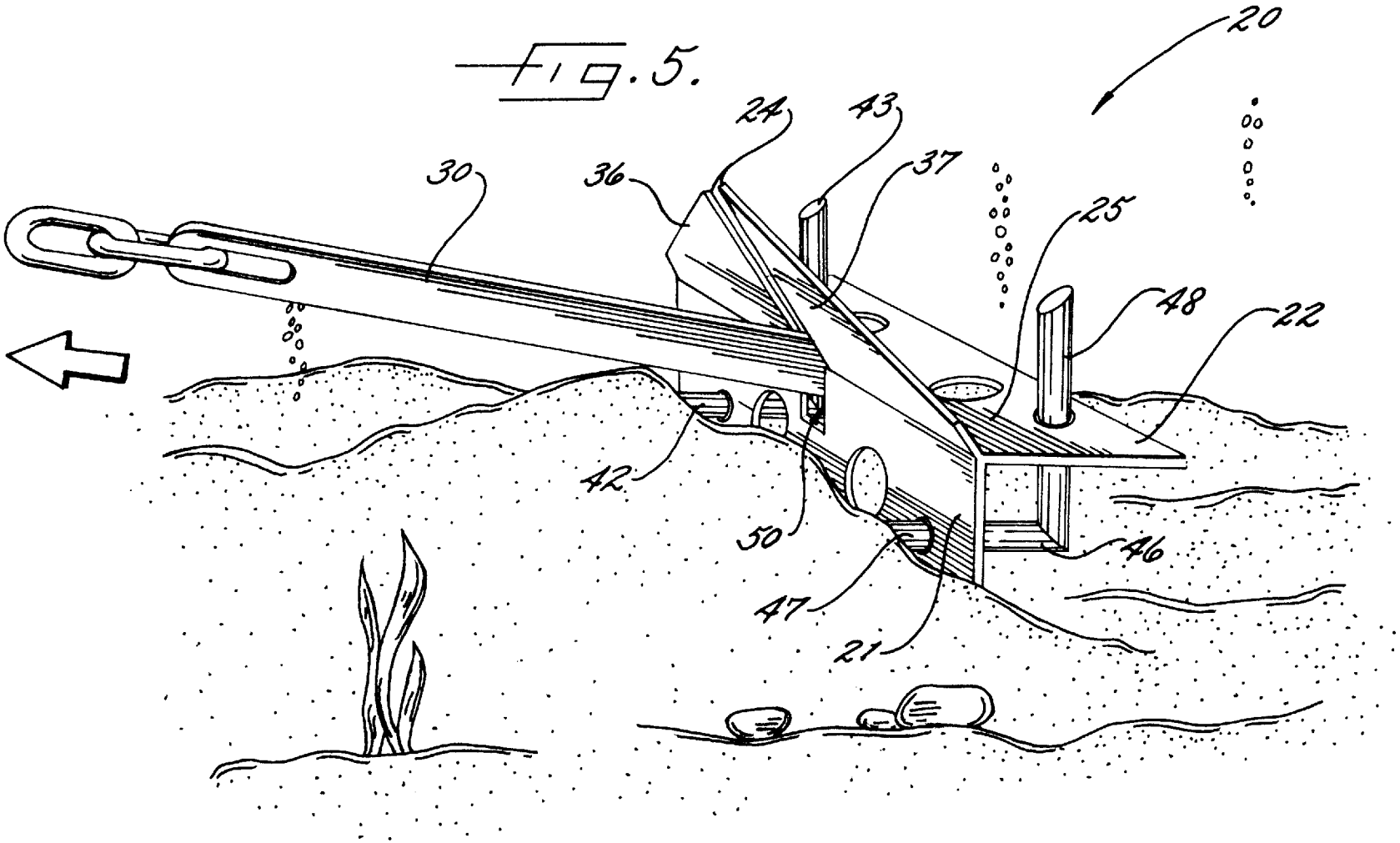
FIG. 5 is a perspective environmental view of an anchoring apparatus positioned in a second position upon a sandy surface according to an embodiment of the present invention.
Figure 6:
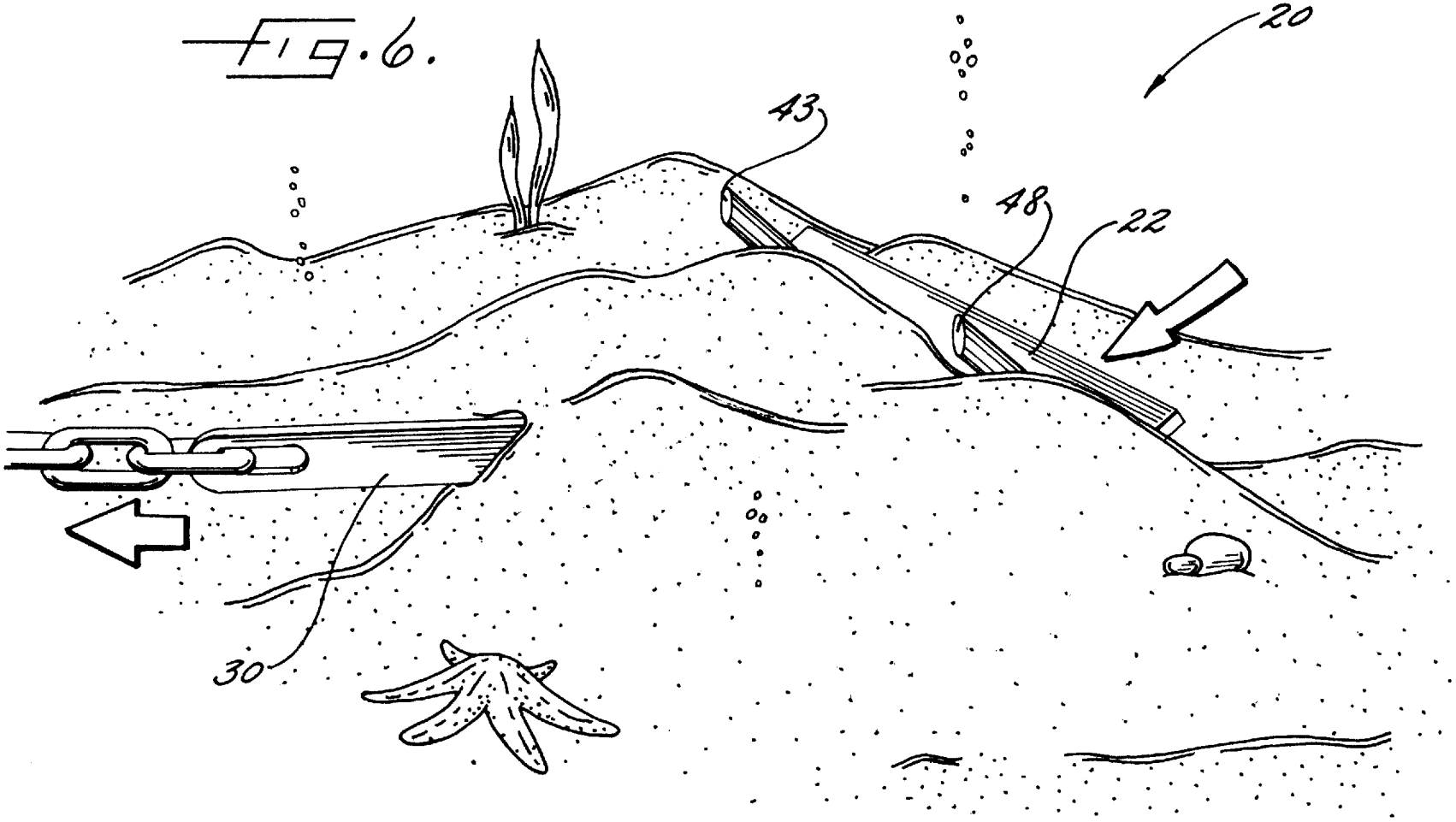
FIG. 6 is a perspective environmental view of an anchoring apparatus positioned in a third position upon a sandy surface according to an embodiment of the present invention.

The present invention will now be described more fully hereinafter with reference to the accompanying drawings, in which a preferred embodiment of the invention are shown. This invention may, however, be embodied in many different forms and should not be construed as limited to the illustrated embodiment set forth herein. Rather, this illustrated embodiment is provided so that this disclosure will be thorough and complete, and will fully convey the scope of the invention to those skilled in the art. Like numbers refer to like elements throughout.

FIGS. 1–6 illustrate perspective environmental views of an apparatus 20 for anchoring a buoyant device, such as a boat, according to the present invention. As illustrated, the anchoring apparatus 20 can advantageously be used for multiple purposes in various underwater terrain, e.g., sand, rock, logs, brush, sea plants, underwater caverns, and man-made obstacles, to provide effective anchoring functions. The anchoring apparatus 20 preferably has first and second plates 21, 22 adjoined along a common line 23. An end of the second plate 22 is transversely connected to or adjoined to an end of the first plate 21 along the common line 23 and extends inwardly therefrom at a predetermined angle $\Theta$ so that the first and second plates 21, 22 in combination define an angled plate member 25. A third pronged plate 24 is also preferably adjoined along the common line and extends outwardly therefrom in a different direction, e.g., an opposite direction, from the angled plate member 25. More particularly, the angle between the pronged plate and either the first or second plates is preferably greater than 90 degrees.

The angled plate member 25 preferably has a generally L-shape as illustrated. The L-shaped configuration of the angled plate member 25 advantageously provides a wide enough spacing to allow pivoting movement of the angled plate member 25 as described further herein and advantageously provides a structural configuration that is relatively easy and inexpensive to manufacture. Nevertheless, as understood by those skilled in the art, other angled configurations of the angled plate member 25 can be used as well according to the present invention. The angle plate member 25, as well as the other elements of the anchoring apparatus 20, preferably includes an anti-corrosive material either coating the angled plate member 25 or integrally formed therewith.

Figure 8:
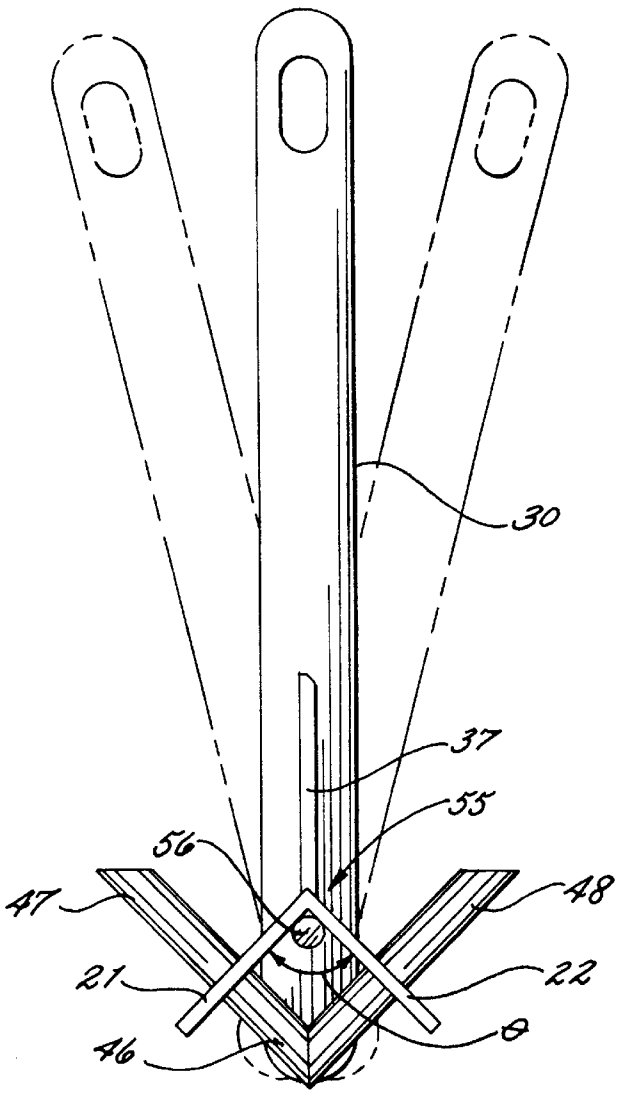
FIG. 8 is a side elevational view of an anchoring apparatus according to an embodiment of the present invention.
Figure 7:
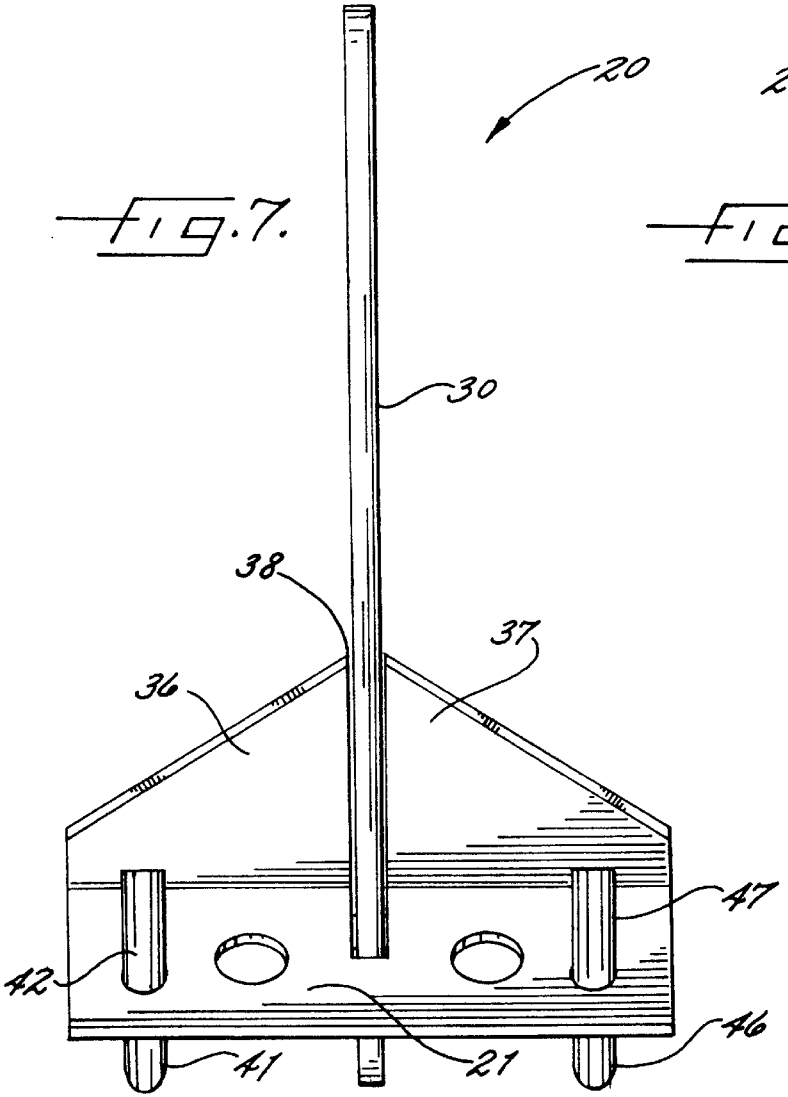
FIG. 7 is front elevational view of an anchoring apparatus according to an embodiment of the present invention.
Figure 9:
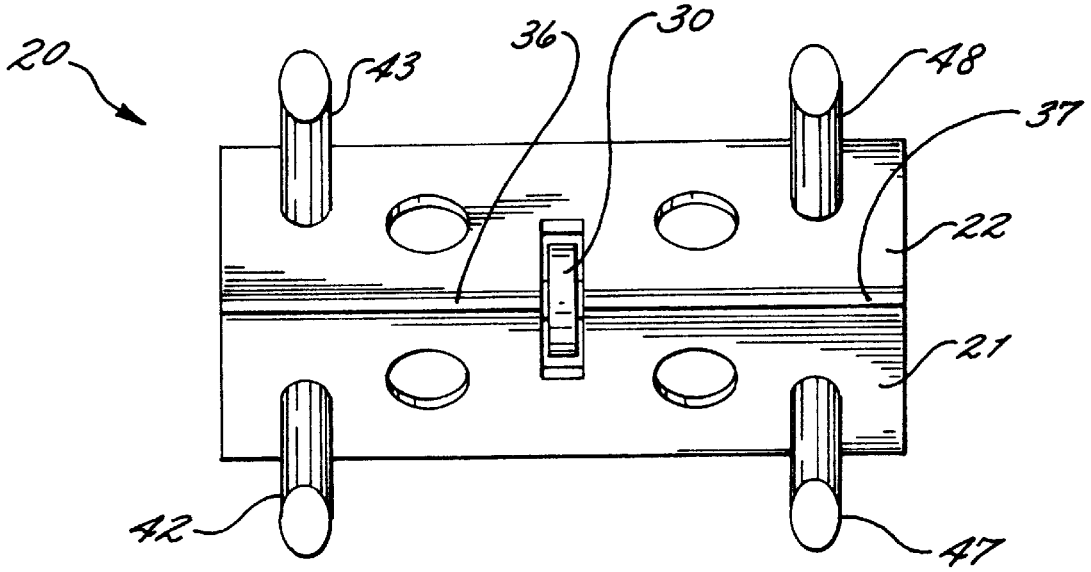
FIG. 9 is a top plan view of an anchoring apparatus according to an embodiment of the present invention.
Figure 10:
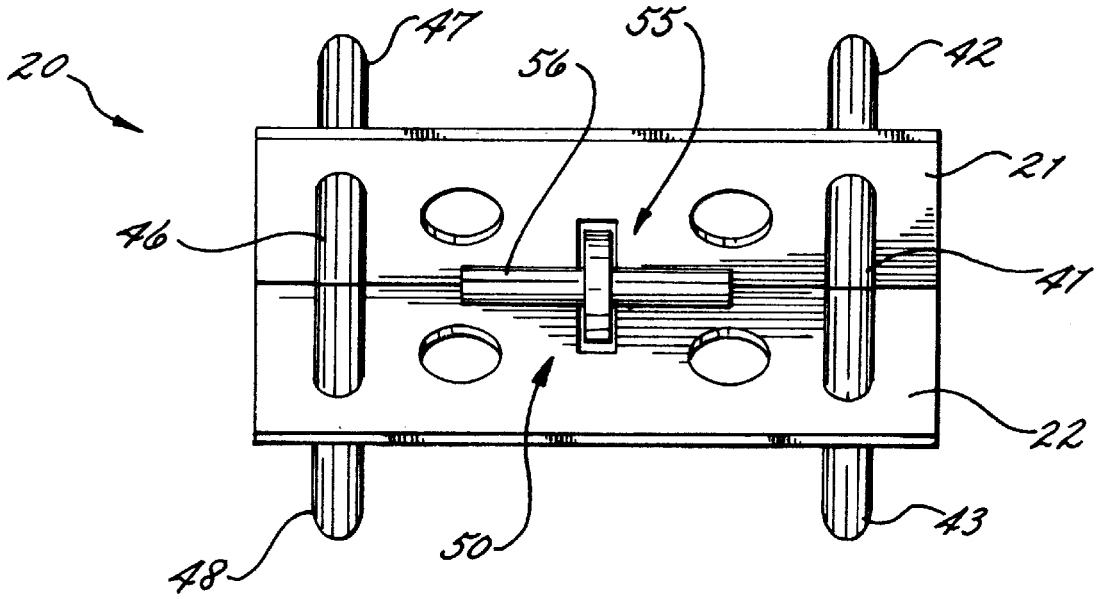
FIG. 10 is a bottom plan view of an anchoring apparatus according to an embodiment of the present invention.

The angle plate member 25 preferably also includes an elongate opening 28 formed in a medial portion thereof. The elongate opening 28 extends into and through end portions of the first and second plates 21, 22 and preferably generally transverse to and through the common adjoining line 23 of the first and second plates 21, 22 (see also FIGS. 8–10). The third plate 24 also has an elongate opening 38 extending from a distal end to a proximate end along, closely adjacent, or through the common line. The elongate opening 38 separates the third plate 24 into a pair of pronged plate portions 36, 37 so that the pair of pronged plate portions 36, 37 and the elongate opening 38 of the third plate 24 enhance the hold of the anchor in sandy terrain. As will be described further herein, the opening 28 and the elongate opening 38 of the third plate 24 can also form a part of plate positioning means 50 which functions to adaptively position the angled plate member 25 and the third plate 24 in a plurality of positions for various underwater terrain.

A shank 30 is pivotally connected to a medial portion of the angled plate member 25 and extends outwardly therefrom. The shank 30 is preferably an elongate shaft or rod that has a distal end portion thereof which extends through the elongate opening 28 in the angled plate member 25. The shank 30 preferably has an oblong shape for correspondingly fitting through the elongate opening 28. As illustrated, the shank 30, however, also preferably is small enough to allow for slack or sliding movement within the opening 28. The proximal end portion of the shank 30 preferably is adapted to connect to an anchoring line such as a chain, cable, or rope connected to a boat or other buoyant device.

As perhaps best illustrated in FIGS. 2–6 and 8–10, a pair of hook members 41, 46 extend through and between each of the first and second plates 21, 22 of the angled plate member 25. End portions of each of the hook members 41, 46 define a pair of corresponding prong members 42, 47 and 43, 48 which extend outwardly from the outer surface of each of the first and second plates 21, 22 of the angled plate member 25. The prong members 42, 43, 47, 48, e.g., sharpened or extending to form a conical point, advantageously engage or assist in embedding the anchoring apparatus 20 into the surface of the underwater terrain where the anchoring apparatus 20 rests after launching.

Each of the pair of hook members 41, 46 also arcuately extends between the first and second plates 21, 22 of the angled plate member 25. This extension of the pair of hook members 41, 46 advantageously strengthens the structure of the angled plate member 25 and inhibits the angled inner surface of the angled plate member 25 from entanglement and abutting contact with various underwater obstacles or terrain. This extension of the pair of hook members 41, 46 also advantageously protects the pivotal connection of shank 30 with the angled plate member 25. Because the structure of the anchoring apparatus 20 as described is light weight and easy to manufacture, the anchoring apparatus 20 can advantageously be produced in high volume, be relatively inexpensive, and be easily sized for various uses.

Plate positioning means 50 is connected to the shank 30 and the angled plate member 25 for adaptively positioning the angled plate member 25 in various arrangements for various types of underwater terrain surfaces and for adaptively removing the angled plate member 25 when secured to various underwater terrain surfaces. As best illustrated by the phantom lines in FIG. 8 and the arrows of FIGS. 2–6, the plate positioning means 50 includes pivotal connecting means 55 connected to a distal end portion of the shank 30 for pivotally connecting the shank 30 to the medial portion of the angled plate member 25. The plate positioning means preferably also includes the elongate opening 28 formed in the medial portion of the angled plate member 25. The pivotal connecting means preferably includes an elongate rod 56 transversely connected to at least the distal end portion of the shank 30. The elongate rod 56 is also preferably connected to or secured to the inner surface of the angled plate member 25, e.g., preferably secured along the inner surface of the common adjoining line 23 in the medial portion of the angled plate member 25. The shank 30 preferably pivots about the elongate rod 56 and slidably moves within the elongate opening 28 as illustrated in FIGS. 1–10.

As illustrated in FIGS. 1–6, the distal end portion of the shank 30 pivots between at least three positions. A first position preferably has a first portion of the outer surface of the distal end portion of the shank 30 abuttingly contacting the inner surface of the first plate 21. This first position, for example, inhibits the pivoting movement or motion further in the direction of the first plate 21 and, yet, also advantageously provides increased leverage for the shank 30, especially during removal or dislodging from the underwater terrain surface into which it is embedded. A second position preferably has a second portion of the outer surface of the distal end portion of the shank 30 abuttingly contacting the inner surface of the second plate 22. This second position, for example, like the first position also inhibits the pivoting movement or motion further in the direction of the second plate 22 and, yet, also advantageously provides increased leverage for the shank 30, especially during removal or dislodging from the underwater terrain surface into which it is embedded. A third position preferably has the first and second portions of the outer surface of the distal end portion of the shank 30 positioned transverse to the inner surfaces of the first and second plates 21, 22. The increased leverage in this third position is advantageously provided by the contact of the elongate rod 56 with the inner surface of the medial portion of the angled plate member 25.

It will be understood by those skilled in the art that the angled plate member 25 and the plate positioning means 50 advantageously cooperate to position the angled plate member 25 in a plurality of positions which include the three positions illustrated and described. Nevertheless, other positions, for example, extending between these positions can advantageously be used as well according to the present invention. By advantageously pivoting between the plurality of positions with the angled plate member 25 and the prongs 42, 43, 47, 48 of the hook members 41, 46 the anchoring apparatus 20 and methods advantageously provide a flexible anchoring device 20 for various types and sizes of boats or other buoyant devices. The anchoring apparatus 20 of the present invention advantageously provides a simple structure and flexible pivoting positions as illustrated and described which also decreases the risk of entanglements during use such as when launched, winched, or removed from the water.

As illustrated in FIGS. 1–10, methods of anchoring an anchoring device 20 are also included according to the present invention. A method preferably includes providing first, second and third plates 21, 22, 24 adjoined along a common line 23. An end of the second plate 22 is transversely connected to an end of the first plate 21 along the common line 23 and extends inwardly therefrom at a predetermined angle 8 so that the first and second plates 21, 22 in combination define an angled plate member 25. The third pronged plate 24 also connects to or adjoins the common line and extends outwardly therefrom in a direction different from the angled plate member 25. The angled plate member 25 has an opening 28 formed in a medial portion thereof. A shank 30 has a distal end portion extending through the opening 28 of the angled plated member 25, is pivotally connected to the angled plate member 25, and extends outwardly from the angled plate member 25. At least one prong member 42, 43, 47, 48 is connected to and extends outwardly from the outer surface of each of the first and second plates 21, 22 of the angled plate member 25. The method also includes pivoting the distal end portion of the shank 30 between a plurality of positions. The plurality of positions preferably includes a first, a second, and a third position (see, e.g., FIGS. 1–6). The first position has a first portion of the outer surface of the distal end portion of the shank 30 abuttingly contacting the inner surface of the first plate 21. The second position has a second portion of the outer surface of the distal end portion of the shank 30 abuttingly contacting the inner surface of the second plate 22. The third position has the first and second portions of the outer surface of the distal end portion of the shank 30 positioned transverse to the inner surfaces of the first and second plates 21, 22. The various pivoting positions of the present invention advantageously provide an anchoring apparatus 20 and method that readily embeds, sets, lodges, braces, or secures a boat or other buoyant device to the various underwater terrain surfaces and yet also readily can be dislodged from the various underwater terrain surfaces.

Another method of anchoring an anchoring device 20 which includes first and second plates 21, 22 adjoined along a common line 23, an end of the second plate 22 being transversely connected to an end of the first plate 21 along the common line 23 and extending inwardly therefrom at a predetermined angle so that the first and second plates 21, 22 in combination define an angled plate member 25 is also included according to the present invention. As best illustrated in FIGS. 1–6, the method preferably includes pivoting the distal end portion of a shank 30 connected to a medial portion of the angled plate member 25 to a first position having a first portion of the outer surface of the distal end portion of the shank 30 abuttingly contacting the inner surface of the first plate, pivoting the distal end portion of the shank 30 to a second position having a second portion of the outer surface of the distal end portion of the shank 30 abuttingly contacting the inner surface of the second plate, and pivoting the distal end portion of a shank 30 to a third position having the first and second portions of the outer surface of the distal end portion of the shank 30 positioned transverse to the inner surfaces of the first and second plates 21, 22.

The method of the present invention can also include applying a force to the proximal end portion of the shank 30 when the anchoring device 20 is positioned in either the first or second position in water and removing the anchoring device 20 from the water. The method can further include applying a force to the proximal end portion of the shank 30 when the anchoring device 20 is positioned in the third position in water and removing the anchoring device 20 from the water.

A method of removing an anchoring device 20 is also advantageously provided according to the present invention. The method preferably includes abuttingly contacting a distal end portion of a shank 30 with an inner surface of an angled plate member 25 of an anchoring device 20 positioned in water, applying a force to the proximal end portion of the shank 30, and winching the anchoring device 20 from the water. The method advantageously can also include leveraging the force applied to the proximal end portion of the shank 30 against the inner surface of the angled plate member 25 and dislodging the anchoring device 20 from the surface of underwater terrain.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. An apparatus for anchoring a buoyant device, the apparatus comprising:

first and second plates adjoined along a common line, an end of said second plate being transversely connected to an end of said first plate along the common line and extending inwardly therefrom at a predetermined angle so that said first and second plates in combination define an angled plate member;

a third pronged plate adjoined along the common line and extending outwardly therefrom in a different direction from the angled plate member;

a shank pivotally connected to a medial portion of said angled plate member and extending outwardly therefrom; and at least one prong member connected to and extending outwardly from the outer surface of each of said first and second plates of said angled plate member.

2. An apparatus as defined in claim 1, wherein said third plate has an elongate opening extending from a distal end to a proximal end along the common line, the elongate opening separating said third plate into a pair of pronged plate portions so that the pair of pronged plate portions and the elongate opening enhance the hold of the apparatus in sandy terrain.

3. An apparatus as defined in claim 1, further comprising plate positioning means connected to said shank and said angled plate member for adaptively positioning said angled plate member and said third pronged plate in various arrangements for various types of underwater terrain surfaces and for adaptively removing said angled plate member when secured to various underwater terrain surfaces.

4. An apparatus as defined in claim 3, wherein said plate positioning means includes pivotal connecting means connected to a distal end portion of said shank for pivotally connecting said shank to the medial portion of said angled plate member.

5. An apparatus as defined in claim 4, wherein said plate positioning means further includes an opening formed in the medial portion of said angled plate member and said third pronged plate, wherein the distal end portion of said shank extends through said opening, and wherein said pivotal connecting means includes an elongate rod transversely connected to at least the distal end portion of said shank.

6. An apparatus as defined in claim 5, wherein said opening in the medial portion of said angled plate member comprises an elongate opening extending through end portions of said first and second plates, and wherein the distal end portion of said shank pivots between at least three positions, a first position having a first portion of the outer surface of the distal end portion of said shank abuttingly contacting the inner surface of said first plate, a second position having a second portion of the outer surface of the distal end portion of said shank abuttingly contacting the inner surface of said second plate, and a third position having the first and second portions of the outer surface of the distal end portion of said shank positioned transverse to the inner surfaces of said first and second plates.

7. An apparatus as defined in claim 5, wherein said opening in the medial portion of said angled plate member comprises an elongate opening extending through end portions of said first and second plates, and wherein the distal end portion of said shank pivots between at least three positions, a first position having a portion of the outer surface of the distal end portion of said shank abuttingly contacting an end of said elongate opening extending along said second plate, a second position having another portion of the outer surface of the distal end portion of said shank abuttingly contacting the other end of said elongate opening extending along said first plate, and a third position having the respective portions of the outer surface of the distal end portion of said shank positioned transverse to the inner surfaces of said first and second plates.

8. An apparatus as defined in claim 1, further comprising a pair of hook members extending through and between each of said first and second plates of said angled plate member, each of said hook members having a pair of prong members, wherein said at least one prong member comprises a pair of prong members connected to each of said first and second plate members, and wherein each of said pair of prong members are prongs of a corresponding hook member of said pair of hook members.

9. An apparatus as defined in claim 8, wherein each of said pair of hook members arcuately extend between said first and second plates of said angled plate member.

10. An apparatus as defined in claim 1, wherein said angled plate member has a generally L-shape and includes an anti-corrosive material.

11. An apparatus for anchoring a buoyant device, the apparatus comprising:

a generally L-shaped plate member;

a pronged plate connected to said L-shaped plate member and extending outwardly therefrom in a different direction from said L-shaped plate member, said L-shaped plate member and said pronged plate having a common open region formed therein; and a shank having a distal end thereof pivotally connected to said L-shaped plate member through the common open region in said L-shaped plate member and said pronged plate.

12. An apparatus as defined in claim 11, wherein said pronged plate has an elongate opening extending from a distal end to a proximal end along the common line, the elongate opening separating said third plate into a pair of pronged plate portions so that the pair of pronged plate portions and the elongate opening enhance the hold of the apparatus in sandy terrain.

13. An apparatus as defined in claim 11, further comprising a plurality of elongate hook members each having a pair of prong members, each of said hook members extending through and between each of the plates of said L-shaped plate member so that each pair of prong members extend outwardly from the outer surface of said L-shaped plate member.

14. An apparatus as defined in claim 11, further comprising plate positioning means connected to said shank and said L-shaped plate member for adaptively positioning said L-shaped plate member in various arrangements for various types of underwater terrain surfaces and for adaptively removing said L-shaped plate member when secured to various underwater terrain surfaces.

15. An apparatus as defined in claim 14, wherein said plate positioning means includes pivotal connecting means connected to a distal end portion of said shank for pivotally connecting said shank to the medial portion of said L-shaped plate member.

16. An apparatus as defined in claim 15, wherein the distal end portion of said shank extends through the common open region of said L-shaped plate member and said pronged plate, and wherein said pivotal connecting means includes an elongate rod transversely connected to at least the distal end portion of said shank.

17. An apparatus as defined in claim 16, wherein each of said pair of hook members arcuately extend between the plates of said L-shaped plate member, and wherein said L-shaped plate member includes an anti-corrosive material.

18. An apparatus for anchoring a buoyant device, the apparatus comprising:

first and second plates adjoined along a common line, an end of said second plate being transversely connected to an end of said first plate along the common line and extending inwardly therefrom at a predetermined angle so that said first and second plates in combination define an angled plate member;

a third plate adjoined along the common line and extending outwardly therefrom in a different direction than said angled plate member, said angled plate member and said third plate having a common open region;

a shank having a distal end portion extending through the elongate opening, being pivotally connected to said angled plate member, and extending outwardly therefrom; and at least one hook member having a pair of prong members, said at least one hook member extending through and between each of the first and second plates of said angled plate member so that each of the prongs of said pair of prong members extends outwardly from the outer surface of said angled plate member.

19. An apparatus as defined in claim 18, further comprising plate positioning means connected to said shank and said angled plate member for adaptively positioning said angled plate member in various arrangements for various types of underwater terrain surfaces and for adaptively removing said angled plate member when secured to various underwater terrain surfaces.

20. An apparatus as defined in claim 19, wherein said plate positioning means includes pivotal connecting means connected to a distal end portion of said shank for pivotally connecting said shank to the medial portion of said angled plate member, said pivotal connecting means including an elongate rod transversely connected to at least the distal end portion of said shank.

21. An apparatus as defined in claim 18, wherein the common open region of said angled plate member and said third plate extends through portions of said first, second, and third plates, and wherein the distal end portion of said shank pivots between at least three positions, a first position having a first portion of the outer surface of the distal end portion of said shank abuttingly contacting the inner surface of said first plate, a second position having a second portion of the outer surface of the distal end portion of said shank abuttingly contacting the inner surface of said second plate, and a third position having the first and second portions of the outer surface of the distal end portion of said shank positioned transverse to the inner surfaces of said first and second plates.

22. An apparatus as defined in claim 18, wherein said third plate has an elongate opening extending from a distal end to a proximal end along the common line, the elongate opening separating said third plate into a pair of pronged plate portions so that the pair of pronged plate portions and the elongate opening enhance the hold of the apparatus in sandy terrain.

23. A method of anchoring an anchoring device, the method comprising:

providing first, second, and third plates adjoined along a common line, an end of the second plate being transversely connected to an end of the first plate along the common line and extending inwardly therefrom at a predetermined angle so that the first and second plates in combination define an angled plate member, the third plate being adjoined to the common line and extending outwardly therefrom in a different direction from the angled plate member, the angled plate member having an opening formed in a medial portion thereof, and a shank having a distal end portion extending through the opening of the angled plated member, pivotally connected to the angle plate member, and extending outwardly therefrom.

24. A method as defined in claim 23, wherein the plurality of positions includes a first position having a first portion of the outer surface of the distal end portion of the shank abuttingly contacting the inner surface of the first plate, a second position having a second portion of the outer surface of the distal end portion of the shank abuttingly contacting the inner surface of the second plate, and a third position having the first and second portions of the outer surface of the distal end portion of the shank positioned transverse to the inner surfaces of the first and second plates.

25. A method as defined in claim 23, wherein the plurality of positions includes a first position having a portion of the outer surface of the distal end portion of the shank abuttingly contacting the end of the elongate opening extending along the second plate, a second position having another portion of the outer surface of the distal end portion of the shank abuttingly contacting the other end of the elongate opening extending along the first plate, and a third position having the respective portions of the outer surface of the distal end portion of the shank positioned transverse to the inner surfaces of the first and second plates.

26. A method of anchoring an anchoring device which includes first, second, and third plates adjoined along a common line, an end of the second plate being transversely connected to an end of the first plate along the common line and extending inwardly therefrom at a predetermined angle so that the first and second plates in combination define an angled plate member and so that the third plate extends outwardly therefrom in a different direction from the angled plate member, the method comprising:

pivoting the distal end portion of a shank connected to a medial portion of the angled plate member to a first position having a first portion of the outer surface of the distal end portion of the shank abuttingly contacting the inner surface of the first plate; and pivoting the distal end portion of the shank to a second position having a second portion of the outer surface of the distal end portion of the shank abuttingly contacting the inner surface of the second plate.

27. A method as defined in claim 26, further comprising pivoting the distal end portion of a shank to a third position having the first and second portions of the outer surface of the distal end portion of the shank positioned transverse to the inner surfaces of the first and second plates.

28. A method as defined in claim 26, further comprising applying a force to the proximal end portion of the shank when the anchoring device is positioned in the first position in water and removing the anchoring device from the water.

29. A method as defined in claim 26, further comprising applying a force to the proximal end portion of the shank when the anchoring device is positioned in the second position in water and removing the anchoring device from the water.

30. A method of removing an anchoring device, the method comprising:

abuttingly contacting a distal end portion of a shank with an inner surface of an angled plate member of an anchoring device positioned in water, the angled plate member having at least one prong extending outwardly therefrom and a pronged plate member connected thereto and extending outwardly in a different direction therefrom;

applying a force to the proximal end portion of the shank;

leveraging the force applied to the proximal end portion of the shank against the inner surface of the angled plate member;

dislodging the anchoring device from the surface of underwater terrain; and winching the anchoring device from the water.

* * * * *